United States Patent [19]

Bray

[11] 4,414,909

[45] Nov. 15, 1983

[54] NEEDLE POSITIONER FOR SEWING MACHINE

[76] Inventor: Murel B. Bray, 3112 Rosa Ave., El Paso, Tex. 79905

[21] Appl. No.: 244,598

[22] Filed: Mar. 17, 1981

[51] Int. Cl.[3] ..... D05B 69/22; D05B 69/08

[52] U.S. Cl. ..... 112/274; 112/221; 112/276

[58] Field of Search ..... 112/275, 276, 277, 220, 112/221, 67, 87, 274

[56] References Cited

U.S. PATENT DOCUMENTS

| | | | |
|---|---|---|---|
| 3,320,914 | 5/1967 | Adams | 112/276 |
| 3,913,508 | 10/1975 | Boser | 112/221 |
| 4,270,474 | 6/1981 | Tice | 112/276 |

*Primary Examiner*—Peter P. Nerbun

[57] ABSTRACT

A needle positioner for a sewing machine having a shaft connected to a main drive motor to move a sewing machine needle reciprocally by a stitching operation which includes a crank rotatably supported on a frame drivably connected to the sewing machine shaft with a plurality of pneumatically actuated cylinder/piston assemblies, the pistons of which are engagable with the crank to move the crank and therefore the shaft through predetermined rotary angles together with a plurality of conduits having valves including control valves therein which are adapted to communicate the cylinder/piston assemblies with a source of pneumatic pressure so that selective actuation of the control valves produces rotary movements of the crank through the appropriate cylinder/piston assembly to move the needle into either a top or bottom position.

8 Claims, 6 Drawing Figures

P
101

32
41
51
34
42
43
31
36
27
37
52
38
26
27
24
47
48
46
33
53
17

NEEDLE POSITIONER FOR SEWING MACHINE

BACKGROUND OF THE INVENTION

Sewing machines are in widespread use for stitching fabric and such use is intensified in the garment industry where production is a prime consideration. In a common type of stitching operation, the operator of the sewing machine is required to elevate the sewing machine needle to an up position when the stitching operation is complete and the work is to be removed from the machine. At the same time, the operator is frequently required during a stitching operation to maintain the needle in a down position penetrating the work so that the position of the work may be adjusted for another phase of the stitching operation. The common practice in the domestic operation of sewing machines is to simply rotate a hand wheel provided on the sewing machine until the needle occupies the desired position which presents no problem since time and labor are inconsequential factors. However, in the garment industry, having vast numbers of sewing machines and operators, the production rate would be slowed by such a manual operation in addition to imposing a burden on the operator with attendant reduction in efficiency and increased distraction on the part of the operator.

It has therefore been proposed to provide such sewing or stitching machines in an industrial operation with a device for automatically positioning the needle of the machine in a pre selected position during a stitching operation or upon the completion of such a stitching operation. However, such present day devices which are usually of the electrical, electro-mechanical or pneumatic type have been characterized by extreme complexity of construction with resulting high cost and have been difficult to maintain in proper adjustment. Furthermore, such present day needle positioning devices frequently require considerable modification or even incorporation within a sewing machine adding further to the initial cost and maintenance of such sewing machines. In addition, such present day needle positioners generally fail to position the needle at the desired location along its reciprocatory path with the degree of accuracy desired further frustrating the operator.

The following patents are representative of the prior art to which the subject invention pertains all of which disclose arrangements which are clearly distinguishable both structurally and functionally from applicant's invention:

U.S. Pat. No. 3,721,204—Schaffer et al.
U.S. Pat. No. 3,812,801—Lukowicz
U.S. Pat. No. 3,541,982—Marforio
U.S. Pat. No. 3,913,508—Boser
U.S. Pat. No. 3,977,339—Tice The Tice patent discloses a needle positioner for a stitching machine which utilizes a pneumatically powered positioning motor drivably connected to the sewing machine for moving the needle into a selected position. The Marforio patent relates to a pneumatic drive system for thread cutting devices on a sewing machine which includes a pneumatic drive device and a sensing device for determining whether the sewing machine needle is in its uppermost position. The Schaffer et al. patent teaches an automatic needle positioning device for a sewing machine which utilizes a treadle that controls a needle positioner mechanism so that the needle raises when the treadle is heeled and where the needle always remains down at the end of a stitching operation.

The Lukowicz patent is of general interest relating to a pneumatic drive system for a sewing machine and the Boser patent is directed to a two-needle pneumatic disengaging mechanism for a sewing machine which incorporates a pneumatically actuated needle bar mechanism controlled by a pedal operator remote and pneumatic valves which selectively control the position of either or both needles.

OBJECTS AND SUMMARY OF THE INVENTION

Accordingly, a primary object of this invention is to provide a new and novel needle positioner for a sewing machine for automatically positioning the sewing needle selectively in the up or down positions.

Another object of this invention is to provide a new and novel needle positioner for a sewing machine which may be easily attached to a sewing machine of conventional construction for selectively controlling the position of the sewing machine needle.

A further object of this invention is to provide a new and novel needle positioner for a sewing machine which is pneumatically operated so as to be completely reliable in operation both from the standpoint of accuracy and maintenance.

Still another object of this invention is to provide a new and novel needle positioner for a sewing machine which is simple and compact in construction, which utilizes relatively available component parts and which permits the needle to be moved to the desired position automatically in a relatively short period of time.

The objects stated above and other related objects are accomplished by providing an assembly which includes a frame having crank means rotatably supported thereon which are drivably connected to the drive shaft of the sewing machine by means of which the sewing needle is moved reciprocally into and out of a workpiece. A plurality of pneumatically actuated drive units are disposed on the frame which are selectively engagable with the crank means to move the crank means into a plurality of predetermined rotary positions to thereby selectively position the sewing machine needle in either an up position or a down position. The pneumatically actuated drive units are connected through valve means to conduit means including a plurality of valves to an associated source of pneumatic pressure the valves being adapted to communicate the pneumatic source selectively with the drive units to selectively move the crank means and therefore the sewing machine needle in the desired up or down position.

Other objects and advantages will become apparent in the following specification when considered in light of the attached drawings.

BRIEF DESCRIPTION OF THE DRAWING FIGURES

DESCRIPTION OF THE PREFERRED EMBODIMENT

Figure 1:
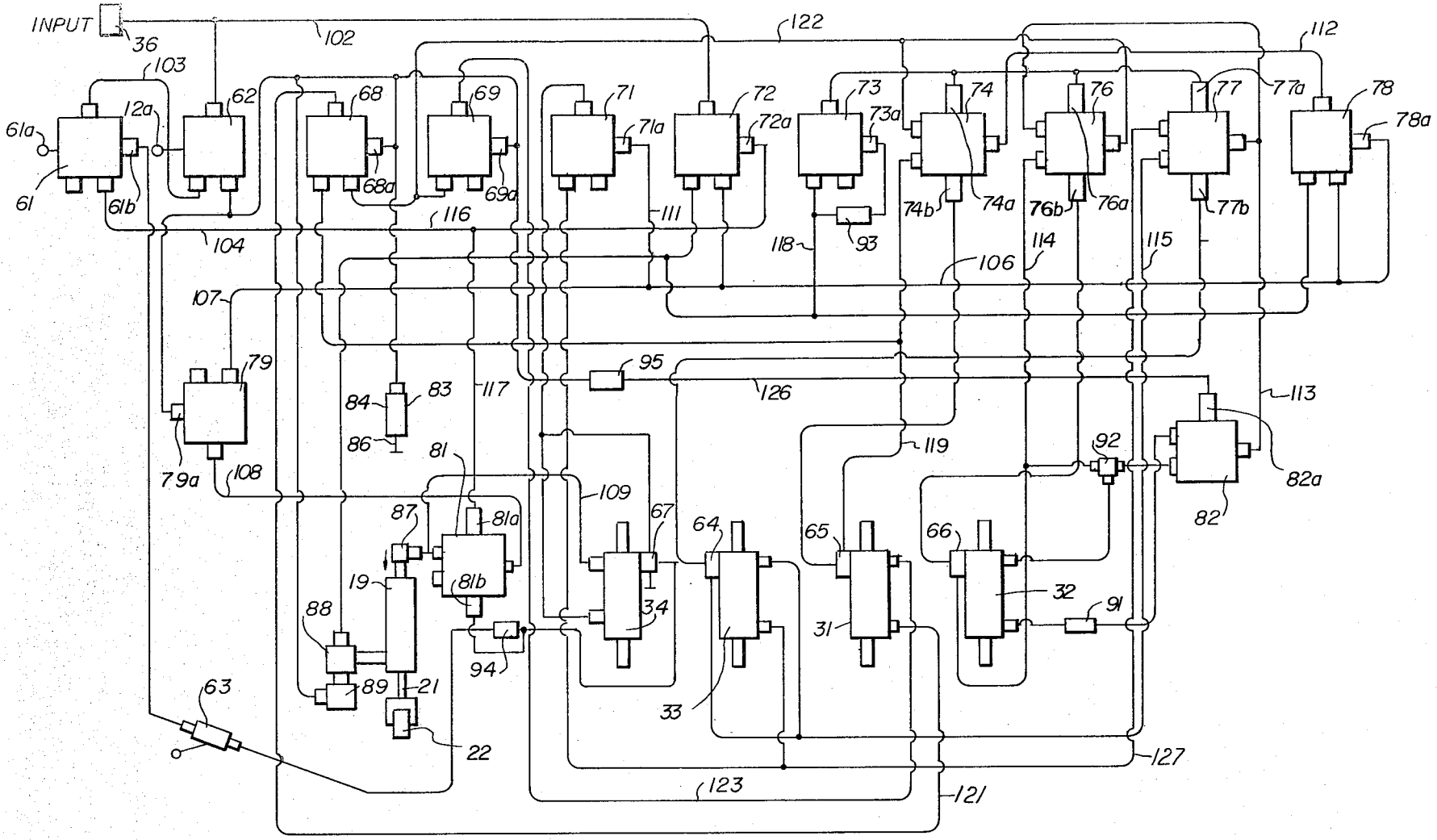
FIG. 1 is a schematic diagram of the system incorporated in the needle positioner of the invention.
Figure 2:
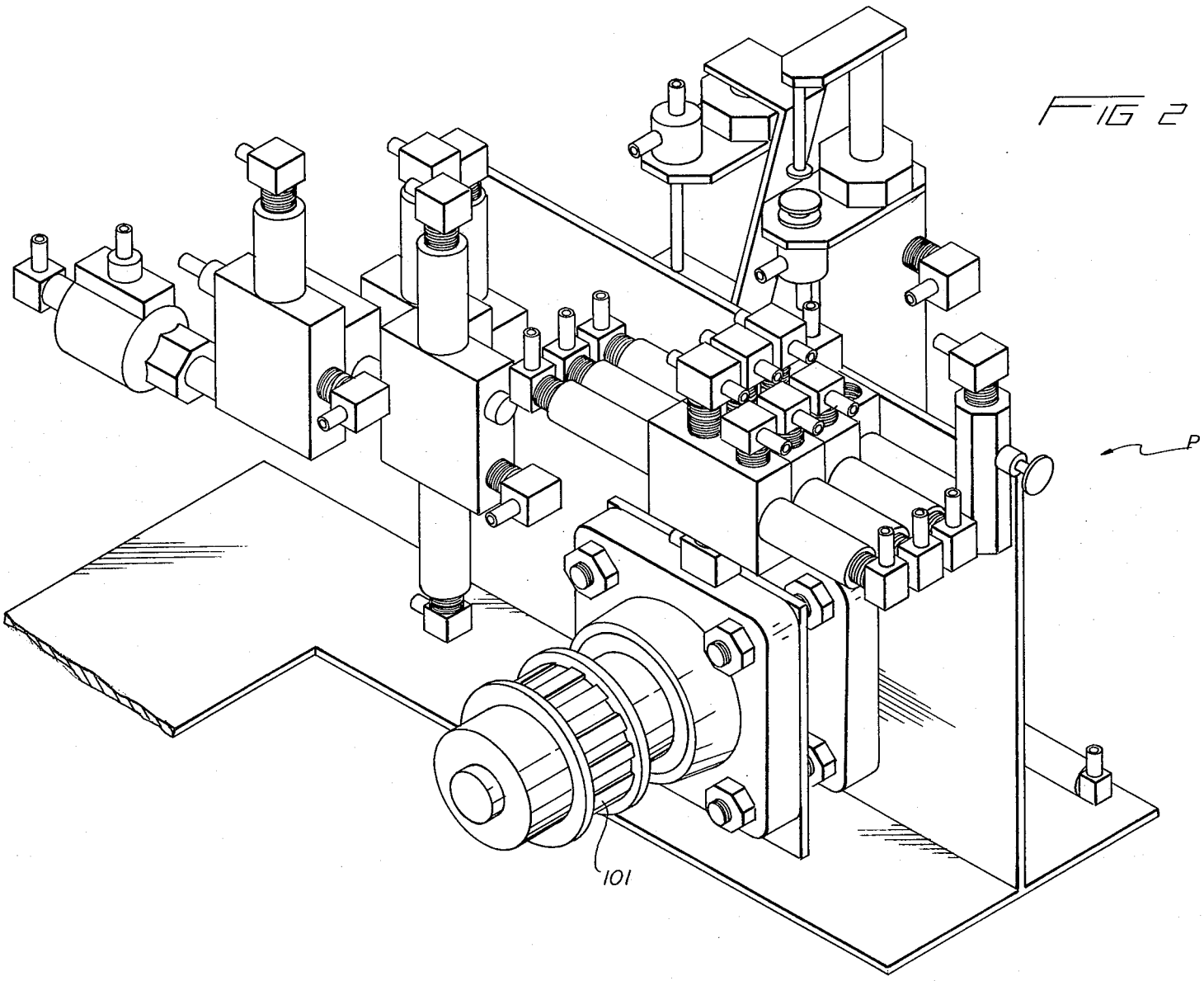
FIG. 2 is a perspective view of the positioner assembly of the invention.
Figure 4:
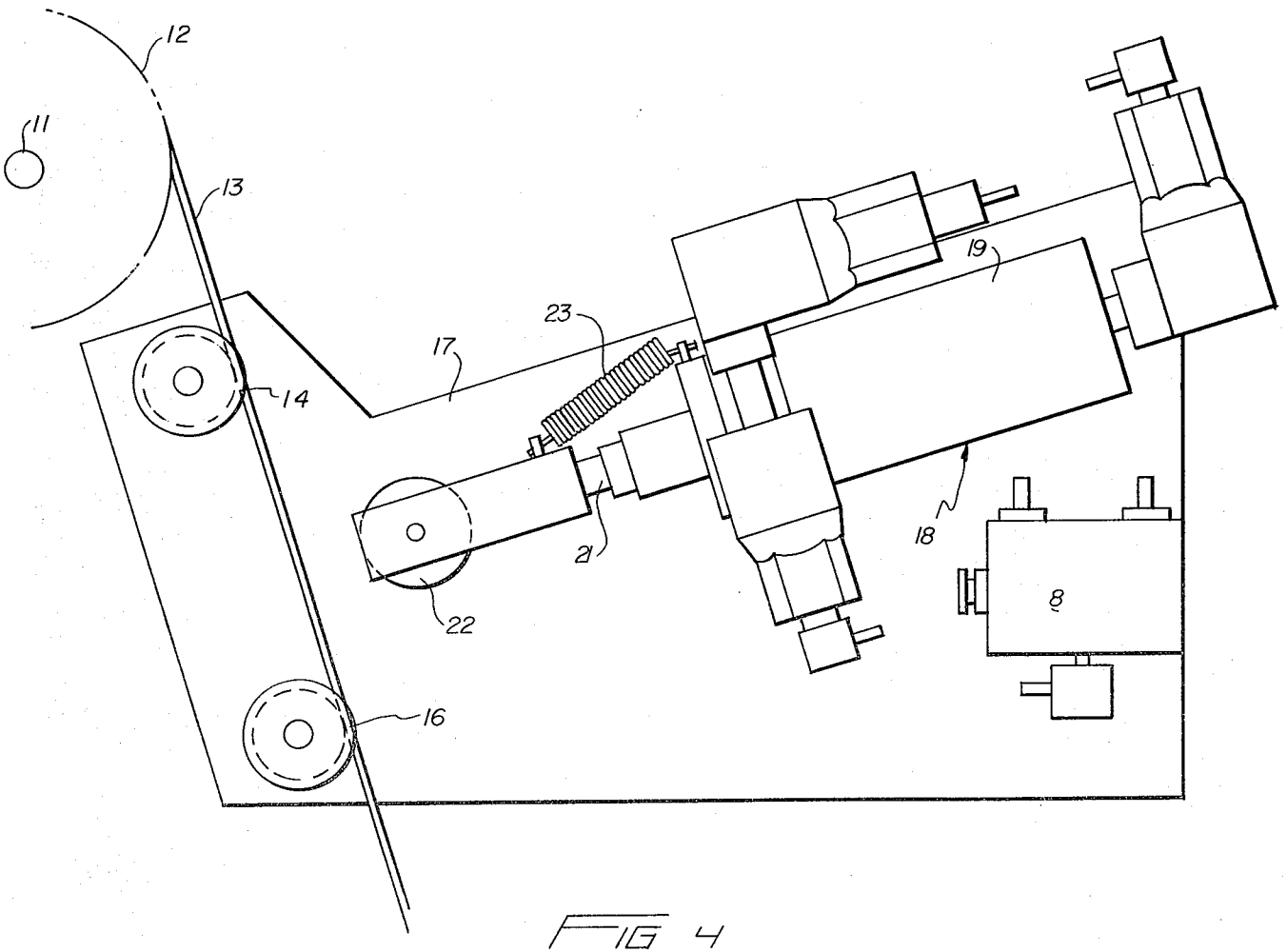
FIG. 4 is an enlarged elevation view of another portion of the apparatus of FIG. 2.

Referring now to FIG. 4, the positioner assembly of the invention is designated generally in FIG. 2 by the letter P the system is shown schematically in FIG. 1 and is adapted to be attached to a sewing machine (not shown) which includes a head having shaft means 11 arranged to be rotated by drive means so as to move the sewing machine needle reciprocally in a vertical path between up and down positions in the wall known manner. The shaft means 11 is provided with a pulley 12 drivably connected to drive means such as a drive motor (not shown) through a belt 13 having idler pulleys 14, 16 associated therewith. Thus, in the position of the belt 13 shown in FIG. 4 with the belt 13 in the relaxed condition, the sewing machine drive is in the relaxed condition for operation of the needle positioner P of the invention. A gear belt pulley 101 (FIG. 2) is associated with pulley 12 and receives a gear belt extending from the needle positioner slaves shaft 24 (FIG. 3) to shaft 11 as will be described hereinafter.

The idler pulleys 14, 16 are rotatably mounted on a frame which includes a plate 17 on which a cylinder-piston drive unit is mounted designated generally by the reference numeral 18. The drive unit 18 includes a cylinder 19 having a rod 21, the outer end of which is provided with a roller 22 and the piston rod 21 is yieldingly retained by means of a spring 23 is in the retracted position within the cylinder 19. The cylinder-piston assembly is pneumatically actuated to move the rod 21 to the left as viewed in FIG. 4 so that the roller 22 moves into tightening engagement with the belt 13 or what is referred to as the "static mode" so that the sewing machine may be operated independently of the needle positioner P.

Figures 3, 6:
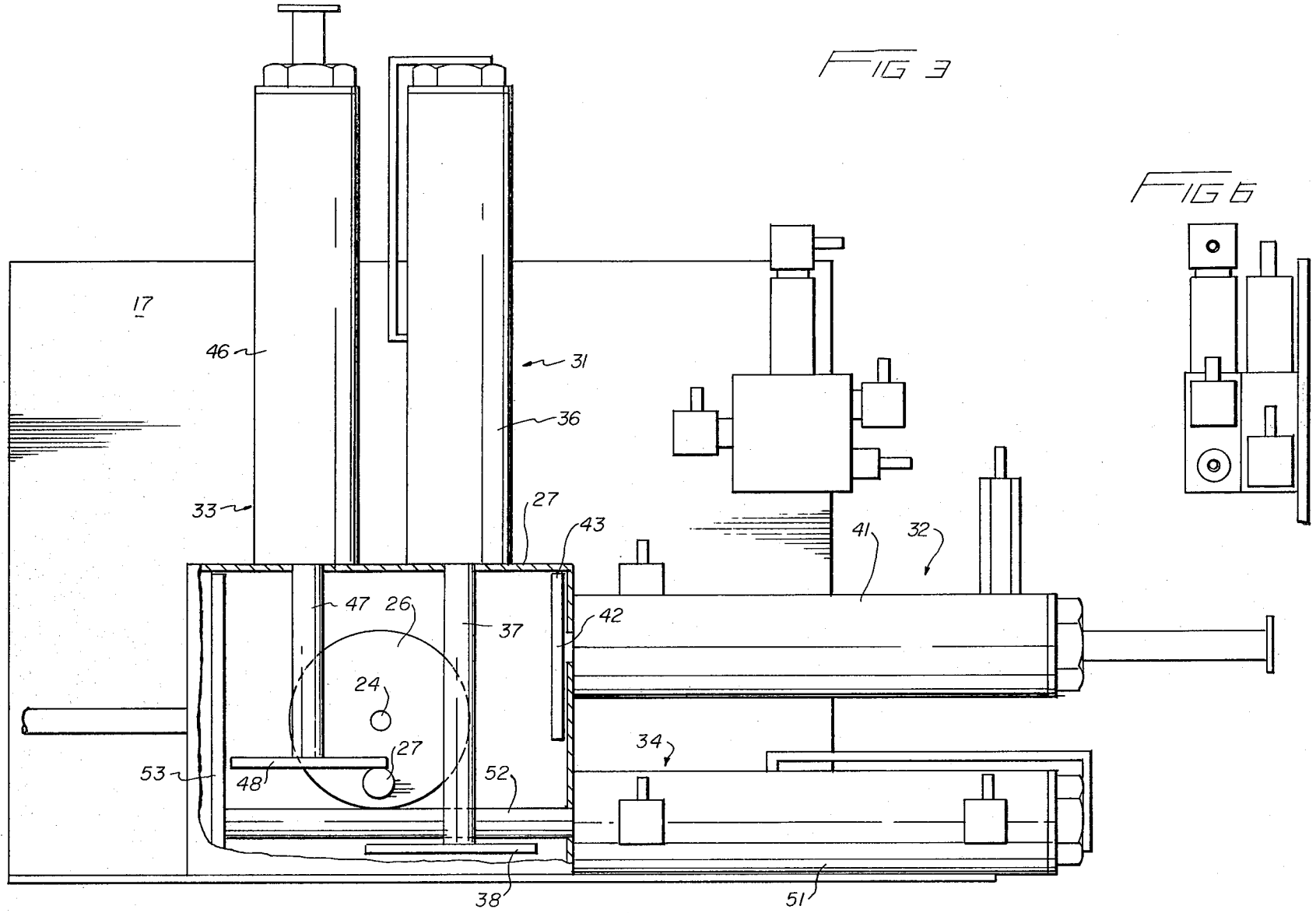
FIG. 3 is an enlarged elevation view partially in section of a portion of the apparatus of FIG. 2.
FIG. 6 is an end view of a portion of the apparatus of FIG. 3.
Figure 5:
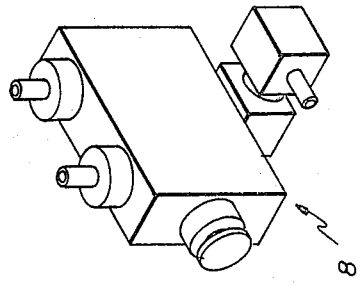
FIG. 5 is a perspective view of a portion of the mechanism of FIG. 4.

Referring now to FIG. 3, the needle positioner P includes crank means rotatably mounted on the frame 17 which includes a shaft 24 having a disc 26 at one end suitably disposed within a enclosure 27. The outer face of the disc 26 is provided with an upstanding lug 27 radially offset from the shaft 24. Pneumatically actuated drive units such as cylinder/piston assemblies designated generally by the reference numerals 31, 32, 33 and 34 are operatively associated with the crank means each of which will be explained hereinafter and are pneumatically actuated from a source of pneumatic pressure 36 as shown in FIG. 1. Each of the pneumatically actuated drive units 31, 32, 33 and 34 comprise a cylinder/piston assembly for rotating the crank means through increments of 90°. More specifically, drive unit 31 includes a cylinder 36 having a piston rod 37 the end of which is provided with a plate 38 with the piston rod being movable vertically as viewed in FIG. 3 from the solid line static position into engagement with the lug 27. Drive unit 32 includes a cylinder 41 having a rod 42 the outer end of which is provided with a plate 43 movable from the solid line static position of FIG. 3 horizontally into engagement with the lug 27. Drive unit 33 includes a cylinder 46 having a rod 47 the outer end of which is provided with a plate 48 the rod being movable for a retracted static position into the solid line position of FIG. 3 in engagement with the lug 27. Drive unit 34 includes a cylinder 51 having a piston rod 52 the outer end of which is provided with a plate 53 movable from the solid static position of FIG. 3 horizontally into engagement with the lug 27.

Referring now to FIG. 1, there is shown a schematic diagram of the needle positioner P of the invention which includes conduit means having valve means for communicating the drive units selectively; cylinder/piston assemblies 31, 32, 33 and 34 and the cylinder/piston assembly 19 are associated operatively with the source of pneumatic pressure 36. More specifically, the system of FIG. 1 includes a manually operated control valve 61 (one way valve with air return), manually operated control valve 62 (one way valve with spring return) and manually operated on/off valve 63. The valve means also includes mechanically operated control valves 64 65, 66, and 67 operatively associated with the cylinder/-piston units 33, 31, 32 and 34 respectively. Also included in the valve means are pneumatically operated control valves 68, 69, 71, 72, 73, 74, 76, 77, 78, 79, 81 having air pressure control valves 81*a*, 81*b* and 82. Cylinder/piston assembly 83 having a cylinder 84 and a rod 86 is also provided in the system of FIG. 1 together with 5 quick release valves 87, 88, 89, 91 and 92. The system of FIG. 1 also includes three air flow regulators 93, 94, and 95. As shown in FIG. 2, the shaft 24 is provided with a gear belt pulley 101 which is drivably connected by means of a gear belt (not shown) with the stitching machine's gear pulley 12 by means of which the sewing machine needle is reciprocated so that as the shaft 24 is rotated as will be explained hereinafter the needle is moved to the desired position on its vertical path.

To condition the sewing machine with which the needle positioner P is associated for the static mode, air is supplied from the source 36 on conduit 102 to control valve 62 and through conduit 103 to control valve 61. Pressurized air is also applied to control valve 72 through conduit 102 and from control valve 72 to control valve 78, 78*a* on conduit 106. Pressurized air flows through conduit 107 through control valve 79 through conduit 108 through control valve 81 and quick release valve 87 to the cylinder 19 moving the rod 21 and therefore the roller into tightening engagement with the belt 13 with the system in a static position and allowing the sewing machine to operate independently of the needle positioner P. Pressurized air is also fed to cylinder 34 through conduit 109 to hold cylinder 34 in a static position.

Pressurized air flowing through pneumatically operated control valve 72 is applied to the pressure control valve 71*a* of control valve 71 through conduit 111 releasing the air from cylinder 34 allowing the piston rod 52 associated with cylinder 34 and manually operated control valve 61 to return to their static positions. Pressurized air applied to the pressure control valve 78*a* of control valve 78 allows pressurized air to flow through control valve 74, 76, 77 from conduit 112 through conduits 122, 121, 113 and 127 to cylinders 31, 32 and 33 respectively.

To position the sewing machine in the up position, pushbutton 61*a* of control valve 61 allows air from control valve 62 to flow through control valve 61 applying pressurized air to the pressure control valve 72*a* of control valve 72 along conduit 116 and to the pressure control valve 81*a* of control valve 81 along conduit 117. This changes the flow of air through control valve 72 removing pressurized air from control valves 79, 81 and cylinders 34, 19 as well as the pressure control valve 78*a* of control valve 78 changing the flow of air through control valve 78 to release air in the pressure control valve 78*a* so that air exhausts back through the exhaust port of control valve 72. The pressurized air in cylinder 19 exhausts through the exhaust port 87 and pressurized air in control valves 79, 81 and cylinder 34 exhausts through the exhaust port of control valve 72. Air flowing from control valve 72 through control valve 73 on conduit 118 applies pressure to the pressure control valves 74*a*, 76*a* and 77*a* of control valves 74, 76 and 77 respectively to change these control valves from a static mode to positioner operation mode.

Pressurized air flowing into control valve 73 is also applied to air flow regulator 93 applying pressure to the pressure control valve 73*a* of control valve 73. Air flow regulator 93 is adjusted to permit time for the pressure applied to control valves 74*a*, 76*a* and 77*a* on control valves 74, 76 and 77 respectively, through control valve 73 changing their flow of air to release the air in cylinders 31, 32 and 33 so that air exhausts through control valve 74, 76 and 77 exhaust ports before pressure is built up in the pressure control valve 73*a* of control valve 73 to change the flow of air through control valve 73 thereby allowing the pressure applied to the pressure control valve 74*a*, 76*a*, 77*a* of control valves 74, 76 and 77 to exhaust back through control valve 73 to the atmosphere.

In the needle up operation, there is a 360° positioning cycle for the shaft 24 during which control valve 73 is maintained in the aforementioned position.

Pressurized air from control valve 72 flows through control valve 78 on conduit 112, through control valve 74 to the mechanical control valve 65 on conduit 119 where it stops while pressurized air flows through control valve 68 to cylinder 31 on conduit 121 applying pressure to cylinder 31. Air pressure in cylinder 31 moves the piston rod 37 which makes mechanical contact with mechanical control valve 65 allowing pressurized air to flow through valve 65 to the pressure control valve 74*b* on control valve 74 changing the air flow through control valve 74. Pressurized air now flowing through control valve 74 is applied to control valve 68 through conduit 122 which is held for the NEEDLE DOWN mode of operation.

Pressurized air also flows through control valve 69 to cylinder 31 on conduit 123 returning the piston rod 37 to its static position releasing the air in the pressure control valve 74*b* of control valve 74 letting the air exhaust back through the exhaust port of mechanical control valve 65.

Pressurized air also flows through control valve 76 on conduit 114 to the mechanical control valve 66 of cylinder 32 through quick release valve 92 (a 3-way valve) to cylinder 32. Air pressure applied to cylinder 32 moves the cylinder rod 42 which makes mechanical contact with mechanical control valve permitting pressurized air to flow through mechanical control valve 66 and applies pressure to pressure control valve 76*b* of control valve 76 changing the air flow through control valve 76.

Pressurized air now flows through control valves 76 and 77 to mechanical control valve 64 on cylinder 33. Pressurized air flowing through control valves 76 and 82 and quick release valve 91 is also fed to cylinder 32 returning its piston rod 42 to its static position releasing air in the pressure control valve 76*b* of control valve 76 and permitting the air to exhaust back through the exhaust port of the mechanical control valve 66 of cylinder 32.

Pressurized air in cylinder 33 moves the cylinder rod 47 so that it makes mechanical contact with the mechanical control valve 64 releasing air to the pressure control valve 77*b* on control valve 77 changing the flow of air through control valve 77. This change in air flow through control valve 77 is now applied to cylinder 33 returning its piston rod 47 to its static position, releasing the air in the pressure control valve 77*b* of control valve 77 and letting the air exhaust back through the exhaust port of mechanical control valve 64. Air also flows through control valve 71 and is supplied to cylinder 34 and the mechanical control valve 67 so that the piston rod 52 of cylinder 51 makes contact with the lug 27 moving the shaft 24 to the 0° position completing the 360° cycle. At the 357°–360° position, the piston rod 52 of cylinder 51 contacts the mechanical control valve 67 releasing air to the pressure control valve 81*b* of control valve 81 as well as applying pressurized air to the pressure control valve 61*b* of control valve 61 through air flow regulator 94 and the on/off valve 63 so that valves 61 and 81 will revert back to their static mode.

Air flow regulator 94 is adjusted to allow the air pressure to the pressure control valve 81*b* of control valve 81 to equal the pressure in the other pressure control valve 81*a* before the pressure in the pressure control valve 61*b* of control valve 61 reverts back to its static mode (if no manual pressure is applied to button 61*a*).

Control valve 61 in its static mode releases the pressurized air in the pressure control valves 72*a* and 81*a*, respectively. The release of air in the pressure control valve 81*a* of control valve 81 allows the pressure in the pressure control valve 81*b* to revert control valve 81 back to its static mode. At the same time, pressurized air from control valve 72 applies air to the pressure control valve 71*a* of control valve 71 changing the flow of air through control valve 71 releasing the air pressure in cylinder 51, the pressure control valve 67, and the pressure control valve 81*b*, 61*b* on control valves 81, 61 respectively permitting the air to exhaust back through control valves 67 and 71 into space. Pressurized air is also supplied to cylinder 51 through valves 79 and 81 to revert it back to the static mode and to cylinder 19 reverting it back to its static mode through quick release valve 87. This completes the 360° cycle for the NEEDLE UP mode of operation and the removal of manual pressure on control valve 61 permits the system to revert back to its static mode. Holding a slight pressure on control valve 61 with pushbutton 61*a* will permit the system to automatically continue recycling. The on/off switch 63 is used for maintenance and for holding the positioner P in the positioning mode.

With respect to the mechanical linkage (gear belt) between the head of the sewing machine and the pneumatic needle positioner P of the invention, the shaft 24 provided with the disc 26 and lug 27 is in the 0° position when the positioner has completed its 360° cycle. Pressurized air is applied to cylinder 36 by manually depressing button 61*a* on control valve 61 so that as air pressure is applied to cylinder 36, the piston rod 37 moves so as to make contact with the lug 27 moving the lug and consequently the shaft 24 approximately 90°. The flow of pressurized air through control valve 74 is changed at the same time returning the rod 37 to its original position and applying pressurized air to cylinder 41 through control valve 76. As the rod 42 of cylinder 41 moves so as to mechanically contact the mechanical control valve 66 plate 43 engages the lug 27 moving the shaft 24 approximately 90° further. The flow of pressurized air is changed through control valve 76 through mechanical control valve 66 so as to apply air through control valve 77 to cylinder 46. The pressure in cylinder 46 moves the piston rod 47 for engagement with the mechanical control valve 64 so that the end plate 48 engages the lug 27 moving it approximately 90° further. The flow of pressurized air is changed in control valve 77 through mechanical control valve 64 applying air pressure through control valve 71 to cylinder 51 moving piston rod 52 and plate 53 for engagement with the lug 27 moving the shaft 24 a further 90°. This completes a 360° cycle leaving the crank at 0°.

In the NEEDLE DOWN operation mode, manually depressing pushbutton 12*a* on control valve 62 applies pressurized air to the control valves 68*a*, 69*a*, 79*a* and 82*a* of control valve 68, 69, 79 and 82 respectively and to cylinder 84 removing pressurized air from control valve 61 and releasing the air from cylinder 31 to the atmosphere through control valve 69. Changing the flow of air in control valve 79 releases the air in cylinder 19 through quick release valve 87 to the atmosphere. At the same time, air pressure applied to cylinder 19 through quick release valves 88, 89 reverses the position of the rod 21 of cylinder 19 releasing pressure on the sewing machine belt 13. Changing the flow of air in control valve 68 allows air from control valve 74 to flow through control valve 68 to cylinder 36 so that piston rod 37 makes contact with the lug 27 on the disc 26 moving the shaft 24 approximately 90° from the 0° position. Pressurized air is also applied to cylinder 84 moving the rod 86 against the peripheral edge of the disc 26 serving as a drag or brake to prevent over shooting of down position. Pressure is also applied through air flow regulator 95 in conduit 126 to the pressure control valve 82*a* of control valve 82 changing the air flow in control valve 82 removing pressure from quick release valve 91 permitting air in cylinder 41 to exhaust through quick release valve 91 as a result of changing the air flow in control valve 69. Changing the flow of air in control valve 82 applies pressurized air to cylinder 41 through quick release valve 92 (a 3-way valve) so that the end plate 43 on piston rod 42 engages the lug 27 moving the shaft 24 from the 90° position to the 180° or down position. Air flow pressure regulator 95 is adjusted to permit cylinder/piston assembly 31 to cycle first and this completes the 180° cycle for the NEEDLE DOWN mode of operation of the needle positioner P. Releasing the manual pressure on button 62*a* of control valve 62 permits the positioner P to revert back to the static mode letting air in cylinder 84 and the pressure control valves 68*a*, 69*a*, 79*a* and 82*a* of control valves 68, 69, 79 and 82 respectively exhaust back through the exhaust port of control valve 62.

Air pressure applied to the needle positioner P, holding it in its static mode, prevents the cylinder rods from engaging the rotating positioning lug 27 while the sewing machine is in normal operation.

Having thus described the preferred embodiment of the invention it should be understood that numerous structural modifications and adaptations may be resorted to without departing from the spirit of the invention.

What is claimed:

1. A positioner assembly for a sewing machine having a head provided with shaft means and drive means connected to said shaft means to move a sewing machine needle reciprocally into and out of a workpiece comprising, in combination, means for disconnecting said drive means from said shaft means, a frame, crank means rotatably supported on said frame, means for drivably connecting said crank means to said shaft means, a plurality of pneumatically actuated drive units on said frame each selectively engagable with said crank means to move said crank means into a plurality of predetermined rotary positions, conduit means including valve means on said frame for selectively communicating said drive units with an associated source of pneumatic pressure for selective actuation of said drive units to thereby position said needle in a selected one of a needle position up and a needle down position wherein said valve means include a manually actuated first valve for selectively connecting said drive units to said associated source of pneumatic pressure to move said needle into the up position and a manually actuated second valve for selectively connecting said drive units to said associated source of pneumatic pressure to move said needle into the down position wherein said drive units include four main cylinder/piston assemblies, each of said main cylinder/piston assemblies being disposed on said frame for selective driving engagement of said pistons with said crank means to rotate said crank means sequentially through increments of approximately 90°.

2. A positioner assembly in accordance with claim 1 wherein said crank means includes a crank shaft rotatably mounted on said frame, a radially disposed crank arm including a lug on said crank shaft, said pistons of said main cylinder/piston assemblies being sequentially engagable with said lug for said incremential rotary movement of said crank shaft.

3. A positioner assembly in accordance with claim 2 wherein said means for drivably connecting said crank means to said shaft comprises a pulley on said crank shaft and belt means for drivably connecting said pulley to said sewing machine shaft means.

4. A sewing machine drive assembly in accordance with claim 3 wherein said drive means is connected to said shaft means by a normally tight belt and pulley assembly and wherein said means for disconnecting said drive means from said shaft means include a secondary pneumatically actuated cylinder/piston assembly having a piston arranged to be moved into engagement with the belt of said belt and pulley assembly and wherein said circuit means are arranged to communicate said secondary cylinder/piston assembly with said source of pneumatic pressure to normally move said piston into tightening engagement with said belt for driving said shaft means and means for moving said piston out of engagement with said belt to maintain said belt in slack condition to disconnect said drive means from said shaft means.

5. A positioner assembly in accordance with claim 4 wherein said circuit means is adapted to continuously connect said main cylinder/piston assembly selectively to said source of pneumatic pressure through said valve means during the actuation of said manually actuated first valve for continuous sequential rotary movement of said crank means.

6. A positioner assembly in accordance with claim 5 wherein said circuit means is adapted to connect said main cylinder/piston assemblies selectively to said source of said manually actuated second valve for sequential rotary movement of said crank shaft from a 0° needle position to a 180° needle down position.

7. A positioner assembly in accordance with claim 6 including a further cylinder/piston assembly having a piston adapted to be connected through said circuit means to said source of pneumatic pressure, said piston of said further cylinder/piston assembly being moveable into braking engagement with said crank means in said 180° needle down position.

8. A positioner assembly in accordance with claim 7 including a spring for normally urging said piston of said secondary cylinder/piston assembly out of tightening engagement with said belt and wherein said circuit means are adapted to normally communicate said second cylinder/piston assembly with said source of pneumatic pressure to move said piston of said secondary cylinder/piston assembly into said belt tightening position to deactivate the needle positioner for stitching operation of said sewing machine.

* * * * *